US012042857B2

(12) United States Patent
Fellsner

(10) Patent No.: US 12,042,857 B2
(45) Date of Patent: Jul. 23, 2024

(54) INGOT MOULD FOR CONTINUOUS CASTING WITH A LUBRICANT CHANNEL OPENING TO THE RUNNING SURFACE

(71) Applicant: Hertwich Engineering GmbH, Braunau (AT)

(72) Inventor: Christian Karl Fellsner, Roßbach (AT)

(73) Assignee: Hertwich Engineering GmbH, Braunau (AT)

( * ) Notice: Subject to any disclaimer, the term of this patent is extended or adjusted under 35 U.S.C. 154(b) by 0 days.

(21) Appl. No.: 18/265,594

(22) PCT Filed: Dec. 2, 2021

(86) PCT No.: PCT/EP2021/084052
§ 371 (c)(1),
(2) Date: Jun. 6, 2023

(87) PCT Pub. No.: WO2022/122563
PCT Pub. Date: Jun. 16, 2022

(65) Prior Publication Data

US 2024/0075520 A1 Mar. 7, 2024

(30) Foreign Application Priority Data

Dec. 7, 2020 (EP) ..... 20212290

(51) Int. Cl.
*B22D 11/07* (2006.01)
*B22D 7/06* (2006.01)

(52) U.S. Cl.
CPC ..... *B22D 7/06* (2013.01); *B22D 11/07* (2013.01)

(58) Field of Classification Search
CPC ..... B22D 11/07
See application file for complete search history.

(56) References Cited

U.S. PATENT DOCUMENTS

| | | | | |
|---|---|---|---|---|
| 4,157,728 | A | 12/1979 | Mitamura et al. | |
| 4,437,508 | A | 3/1984 | Pryor et al. | |
| 5,682,942 | A | 4/1997 | Perrin et al. | |
| 6,609,557 | B1 * | 8/2003 | Anderson | B22D 11/07 164/268 |
| 2012/0186772 | A1 | 7/2012 | Shaber et al. | |

FOREIGN PATENT DOCUMENTS

| | | | |
|---|---|---|---|
| CH | 361093 A | * | 3/1962 |
| DE | 27 34 388 A1 | | 2/1978 |

OTHER PUBLICATIONS

EPO machine translation of CH 361093 A (Year: 1962).*

* cited by examiner

*Primary Examiner* — Kevin E Yoon
(74) *Attorney, Agent, or Firm* — Tiajoloff & Kelly LLP

(57) ABSTRACT

An ingot mould for continuous casting, with a lubricant channel (2) opening to the running surface (1), has a distribution portion (3) adjoining the running surface (1). In an ingot mould of the aforementioned type a uniform lubrication of the running surface of the ingot mould is possible using as few wear-susceptible components as possible, where the flow resistance within the distribution portion (3) increases in the direction of the running surface (1) and is constant in a discharge region (4) of the distribution portion (3) adjoining the running surface parallel to the running surface (1).

16 Claims, 2 Drawing Sheets

Figure 1:
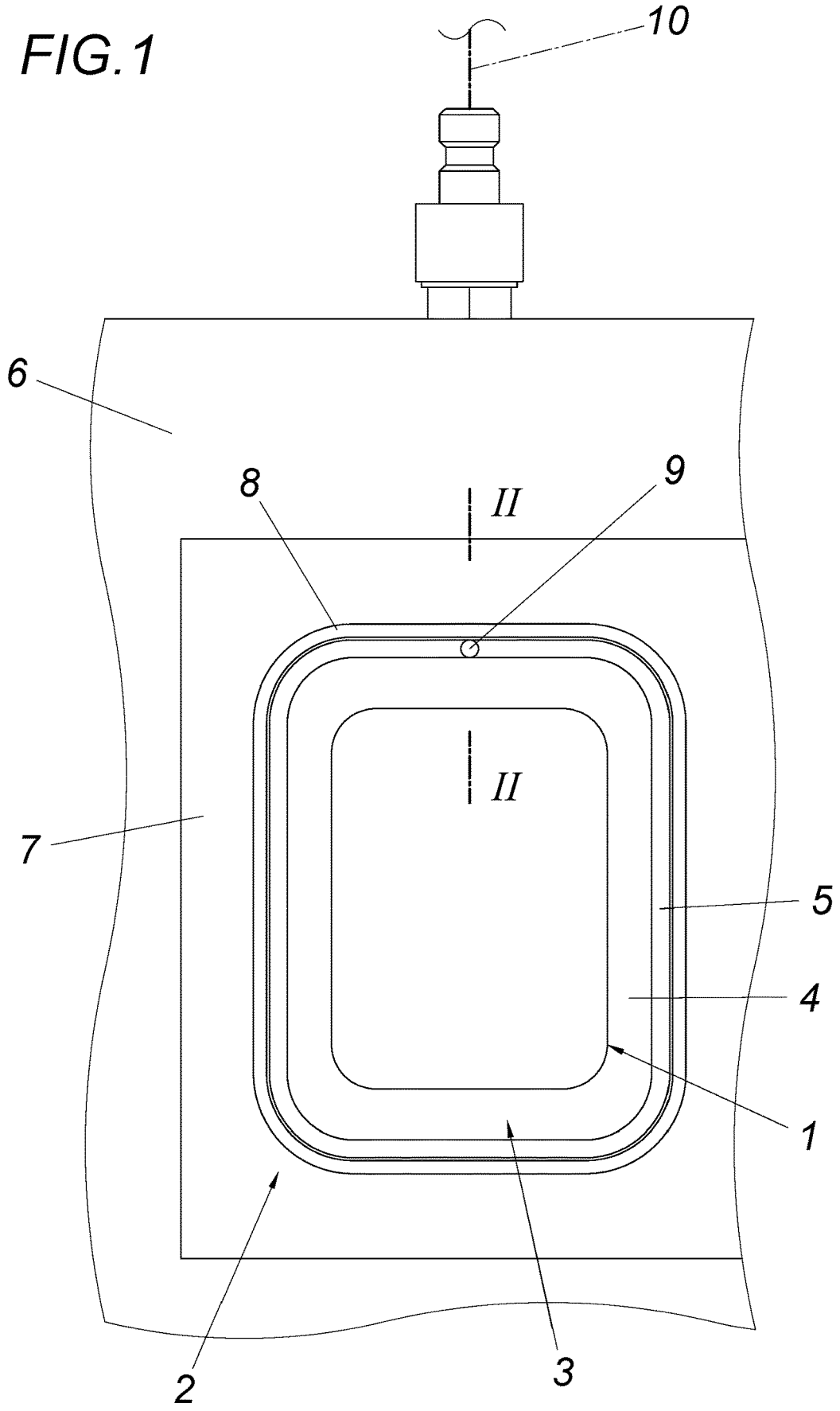

INGOT MOULD FOR CONTINUOUS CASTING WITH A LUBRICANT CHANNEL OPENING TO THE RUNNING SURFACE

TECHNICAL FIELD

The invention relates to an ingot mould for continuous casting with a lubricant channel opening into the running surface, which has a distribution section adjoining the running surface.

PRIOR ART

Various methods for lubricating the running surface of ingot moulds are known in the prior art. Common to all of them is that a film of lubricant should be provided as uniformly as possible between the casting strand and the running surface, which ensures problem-free transport of the casting strand within the ingot mould.

CH361093 discloses a method of lubricating the running surface in which an outer seal defines a circumferential distribution section of the running surface. The distribution section has a plurality of evenly spaced lubricant supply lines and is delimited by a supply section adjacent to the running surface and having a plurality of channels. These channels are also evenly spaced, offset from the lubricant supply lines and allow the lubricant to be supplied to the running surface.

However, a disadvantage of the prior art is that the lubricant does not enter the running surface evenly, but is delivered to the running surface in a concentrated manner via the channels. This uneven distribution reduces not only the transportability mentioned above, but also the surface quality of the cast strand. Although, based on the prior art, a higher number of lubricant supply lines and nozzles could be provided to allow at least more uniform lubrication, this would be accompanied by a considerable additional expense in terms of controls and wear-prone components.

DESCRIPTION OF THE INVENTION

The invention is thus based on the task of enabling uniform lubrication of the running surface of an ingot mould using as few components that are susceptible to wear as possible.

The invention solves the given problem in that the flow resistance within the distribution section increases in the direction of the running surface and is constant in a discharge region of the distribution section adjoining the running surface parallel to the running surface. If lubricant is introduced into the lubricant channel, for example using a fluid line, it first distributes in the areas of lower flow resistance of the distribution section and fills up these areas. Only when the pressure is increased further, for example by the further supply of lubricant, does the lubricant flow further in the direction of the running surface and distribute itself into the regions of higher flow resistance until the discharge region adjoining the running surface is reached. Since the flow resistance is constant in the discharge region parallel to the running surface, there is no preferred entry point for the lubricant to reach the running surface. As a consequence, a further increase in pressure or supply of lubricant causes the running surface to be uniformly wetted from the entire discharge region. Advantageously, the lubricant channel according to the invention requires less than 11, preferably less than 5, and even more preferably only one lubricant supply line in the area of lower flow resistance, since the lubricant is automatically distributed evenly in the areas of lower flow resistance due to the different flow resistances. Different flow resistances can be implemented, for example, through meander structures, surface roughnesses, channel thicknesses, etc. that differ from area to area. Due to its simple design, the lubricant channel can be easily arranged on the mould inlet side and enables improved lubrication already at the beginning of continuous casting.

The entire interaction surface of the cast strand with the running surface can be uniformly lubricated if the discharge region extends circumferentially around the running surface at least in sections. Due to its design, the lubricant channel according to the invention can simply form a continuous, circumferential discharge region to the running surface, as it is not interrupted by any further components, such as nozzles. In this way, the distribution section can extend circumferentially over 10%, preferably over 15%, even more preferably over 25%, 50% or 75%, in particular over 90% of the cross-section of the running surface and preferably over the entire cross-section of the running surface. As a result, every circumferential point of the running surface is equally accessible to the lubricant via the discharge region. This enables a uniform, continuous lubricant film between the running surface and the cast strand.

Alternatively or in addition to the measures already mentioned, the flow resistance within the distribution section can increase in the direction of the running surface by decreasing the cross-section of the lubricant channel in the region of the distribution section towards the running surface.

The lubrication can be implemented simply and with low wear in terms of manufacturing technology by the discharge region having a surface roughness that differs from the rest of the distribution section, with the discharge region preferably having a higher surface roughness than the rest of the distribution section. By increasing the surface roughness in sections, for example by compressed air blasting with solid abrasive, the flow resistance can be precisely influenced locally by simple manual measures, since with the increase in surface roughness meander structures form on the treated parts of the distribution section, which the lubricant must pass through. This treatment can be carried out directly on the ingot mould and repeated if necessary, which means that no further components need to be provided and replaced if necessary. The discharge region can extend in the radial direction over up to 100 mm, in particular over 5 mm.

The lubricant flow rate can be easily and precisely controlled under simplified manufacturing conditions if the discharge region rests against the lubricant channel wall opposite it. In this way, the flow resistance in the direction of the running surface can be increased by simple means, whereby by further manufacturing measures, such as an increase in the surface roughness, a change in the flow cross-section or spacers upstream of the discharge region, it can be implemented that the lubricant can still reach the discharge region and from there continue to the running surface. In this way, the possible throughput of lubricant can be precisely adjusted depending on the applied pressure. To ensure that not only good flow properties for the lubricant exist within the lubricant channel, but also that the flow resistance can be well adjusted, for example by compressed air blasting with solid abrasive, it is suggested that the channel wall sections have a metal surface. It does not matter whether only the surfaces of the channel wall sections are made of metal, or are metallised, or whether the channel walls as a whole are made of metal.

In order to simplify the inspection and maintenance of the components and at the same time further improve the lubrication properties, it is recommended that the discharge region is delimited in the longitudinal direction of the ingot mould by at least two mould components. By means of a screw connection, for example, the mould components can be easily assembled to form the lubricant channel through their interaction. Also, the mould components can be easily detached from each other, allowing the distribution section and the discharge region to be easily inspected and maintained between two operations. In addition, the embodiment allows for simplified fabrication of the lubricant channel walls because they are openly accessible prior to assembly of the individual components. This also allows the lubricant channel to be easily arranged on the mould inlet side, for example by the nozzle plate forming a mould component. This enables the lubricant channel to be arranged in the immediate vicinity of the entry area of the casting strand and thus optimised lubrication conditions right at the start of continuous casting. If, as described above, the channel section facing the running surface with higher surface roughness is adjacent to the opposite channel wall of the distribution section, the flow resistance decreases with increasing surface roughness, since the lubricant can only pass along the meandering structures created by the roughness. In a preferred embodiment, only one of the two mould components needs to be machined to achieve the flow resistance within the distribution section that increases in the direction of the running surface. For example, the distribution section of one mould component may be machined while the distribution section of the other mould component remains unmachined.

A particularly compact design can be achieved if one of the at least two mould components comprises the running surface.

In particular, in a multi-part embodiment of the ingot mould, unintentional leakage of lubricant can be reduced and at the same time the lubricant supply can be controlled more precisely by the lubricant channel being delimited by a seal on the side opposite the distribution section. The seal thereby prevents lubricant from escaping at least partially on the side opposite the distribution section and facing away from the running surface due to the applied pressure, and also enables a pressure-tight connection of the cooperating mould components.

BRIEF DESCRIPTION OF THE INVENTION

Figure 2:
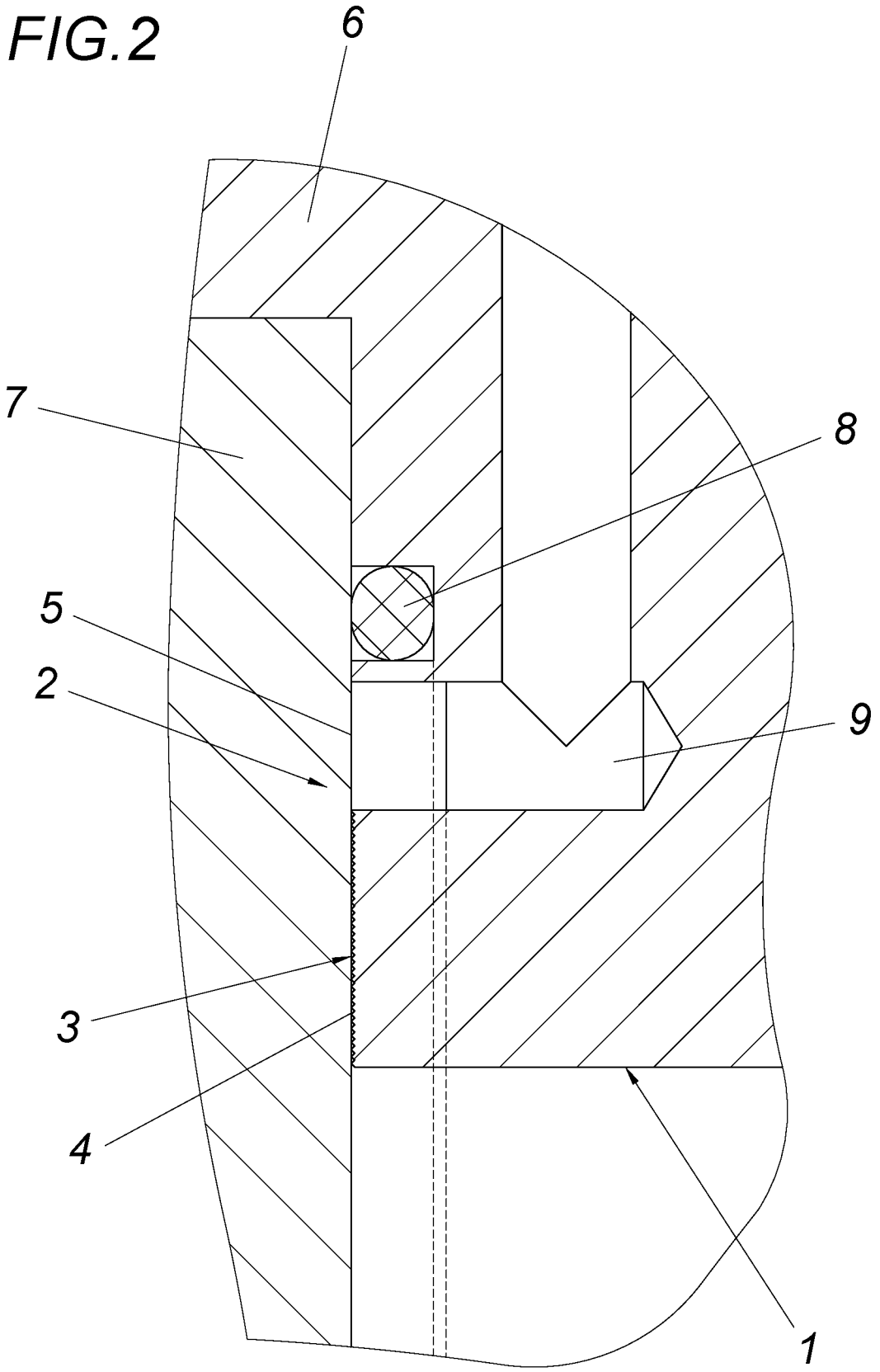

In the drawing, the subject matter of the invention is shown by way of example. It shows FIG. 1A sectional plan view of an ingot mould component of an ingot mould comprising two ingot mould components, and FIG. 2 a sectional view along line II-II of FIG. 1 on an enlarged scale.

WAYS OF CARRYING OUT THE INVENTION

An ingot mould according to the invention for continuous casting comprises a running surface 1, and a lubricant channel 2 opening into the running surface 1 and having a distribution section 3 adjoining the running surface 1. The distribution section 3 comprises a discharge region 4 in which the flow resistance is constant parallel to the running surface 1. Within the distribution section 3, the flow resistance increases in order to induce a uniform distribution of the lubricant in the discharge region 4. This can be implemented, for example, by the discharge region 4 having a smaller cross-section and a different surface roughness than the region 5 of the distribution section 3 upstream of the discharge region 4. As a result of these measures, the distribution section 3 can extend circumferentially around the entire cross-section of a running surface 1 of an ingot mould.

Particularly favourable manufacturing and maintenance conditions result, as illustrated in FIG. 3, if the lubricant channel 2 is not made in one piece, but if two mould components 6, 7 bound the discharge region 4 in the axial longitudinal direction of the ingot mould. In the present embodiment, the two mould components 6, 7 abut each other in the area of the discharge region 4. Due to the rough surface of the discharge region 4 and the resulting fluid connection with high flow resistance to the running surface 1, the pressurised lubricant can pass from the section 5 upstream of the discharge region 4 to the running surface 1 despite the mould components 6, 7 being in contact with each other. Moreover, the cross-section of the lubricant channel 2 is thus reduced in the area of the distribution section 3, preferably abruptly in the transition area between the section 5 upstream of the discharge region 4 and the discharge region 4. If, in addition, one of the two mould components 6 comprises the running surface 1, the second mould component 7 can be constructed relatively compactly and can be replaced if necessary. In order to avoid loss of lubricant and to connect the at least two mould components 6, 7 in a pressure-tight manner, the ingot mould may comprise a seal 8. This seal 8 delimits the distribution section 3 of the lubricant channel 2 on the side opposite the distribution section 3. For lubricant supply, a lubricant supply opening 9 may be provided, which is fed via a supply line 10.

The invention claimed is:

1. An ingot mould for continuous casting, said ingot mould comprising:

a lubricant channel opening to a running surface;

said lubricant channel having a distribution section adjoining the running surface;

wherein flow resistance within the distribution section increases in a direction of the running surface and is constant in a discharge region of the distribution section adjoining the running surface parallel to the running surface, wherein the discharge region is sectioned or continuous and extends circumferentially around the running surface.

2. The ingot mould according to claim 1, wherein the lubricant channel has a cross section that decreases towards the running surface in the region of the distribution section.

3. The ingot mould according to claim 2, wherein the distribution section has a surface roughness, and the surface roughness of the discharge region is different from the surface roughness of the distribution section apart from the discharge region.

4. The ingot mould according to claim 3, wherein the discharge region has a metal surface.

5. The ingot mould according to claim 2, wherein the discharge region rests against a lubricant channel wall opposite thereto.

6. The ingot mould according to claim 2, wherein the discharge region has a metal surface.

7. The ingot mould according to claim 1, wherein the distribution section has a surface roughness, and the surface roughness of the discharge region is different from the surface roughness of the distribution section apart from the discharge region.

8. The ingot mould according to claim 7, wherein the discharge region rests against a lubricant channel wall opposite thereto.

9. The ingot mould according to claim 7, wherein the discharge region has a metal surface.

10. The ingot mould according to claim 1, wherein the discharge region rests against a lubricant channel wall opposite thereto.

11. The ingot mould according to claim 1, wherein the discharge region has a metal surface.

12. The ingot mould according to claim 1, wherein the discharge region is delimited in a longitudinal direction of the ingot mould by at least two mould components.

13. The ingot mould according to claim 12, wherein one of the at least two mould components comprises the running surface.

14. The ingot mould according to claim 1, wherein the lubricant channel is delimited by a seal on the side opposite the distribution section.

15. The ingot mould according to claim 1, wherein the discharge region extends continuously around the running surface without interruption.

16. The ingot mould according to claim 1, wherein the discharge region comprises one or more sections, and the one or more sections extend circumferentially around the running surface.

* * * * *